US005520548A

United States Patent [19]

Hotea et al.

[11] Patent Number: 5,520,548

[45] Date of Patent: May 28, 1996

[54] VIBRATION PROOF ELECTRICAL CONNECTOR HOUSING

[75] Inventors: Gheorghe Hotea, Griesheim; Friedrich J. A. Kourimsky, Bensheim, both of Germany

[73] Assignee: The Whitaker Corporation, Wilmington, Del.

[21] Appl. No.: 258,642

[22] Filed: Jun. 13, 1994

[30] Foreign Application Priority Data

| | | | |
|---|---|---|---|
| Jun. 29, 1993 | [GB] | United Kingdom | 9313393 |
| Jun. 29, 1993 | [GB] | United Kingdom | 9313394 |
| Aug. 26, 1993 | [GB] | United Kingdom | 9317929 |

[51] Int. Cl.[6] ..... H01R 13/627

[52] U.S. Cl. ..... 439/358; 439/271; 439/595

[58] Field of Search ..... 439/593, 595, 439/357, 358, 752, 271

[56] References Cited

U.S. PATENT DOCUMENTS

| | | | |
|---|---|---|---|
| 3,924,922 | 12/1975 | Decenzo | 439/839 |
| 4,900,263 | 2/1990 | Manassero et al. | 439/358 |
| 4,973,268 | 11/1990 | Smith et al. | 439/595 |
| 5,035,661 | 7/1991 | Steinhardt et al. | 439/595 |

FOREIGN PATENT DOCUMENTS

| | | |
|---|---|---|
| 0125786A3 | 11/1984 | European Pat. Off. . |
| 0492479A2 | 7/1992 | European Pat. Off. . |
| 4238321A1 | 5/1994 | Germany . |

*Primary Examiner*—Neil Abrams
*Attorney, Agent, or Firm*—Salvatore Anastasi; Driscoll Nina

[57] ABSTRACT

An electrical connector comprises an electrical receptacle terminal 10 enclosed in an insulating housing 8. The terminal 10 is enclosed in a passageway 64 in the housing 8, the passageway 64 having a flexible wall section 80. Camming surfaces 176, 174 on the housing of a mating connector 6 compress the flexible wall section 80 to produce an interference fit between the flexible wall section 80 and the terminal 10. Movement of the terminal 10 within the passageway 64 is thereby avoided when the mating connectors are subjected to vibration. Latch arms 116 (FIG. 4) on the housing are connected by a U-shaped resilient strap 118 at their rear ends to provide a pivot point about which the latch arms 116 are pivotable between a normal position in which they engage a projection 178 on the mating connector 6 in a latching position. Molding of the housing is also facilitated and the latch arms 116 are protected against damage when the housing is being handled. In another embodiment (FIGS. 16–24), a transversely slidable locking plate 224 is used to move locking lugs 278 on the plate against rearward shoulders 295 of the terminals 238 and through camming surfaces 269, 282 causes rubber members 266 to press against each terminal 238 to reduce vibratory effects. A sealing grommet 9 and grommet retaining ring 11 are also disclosed.

16 Claims, 17 Drawing Sheets

VIBRATION PROOF ELECTRICAL CONNECTOR HOUSING

BACKGROUND OF THE INVENTION

1. Field of the Invention

This invention relates to an electrical connector housing for use in a high vibration atmosphere.

2. Description of the Prior Art

Electrical connectors often are situated in an environment where they are exposed to mechanical load caused by shaking or oscillating movement or vibrations and/or stress due to thermal changes. Examples are electrical connectors used in machines or motor vehicles. If such connectors are situated in the engine compartment of a motor vehicle, not only does heavy mechanical load of the above-mentioned kind occur but also high differences in temperature occur especially during wintertime between the motor vehicle at standstill and being driven.

If the two connectors of a connector pair are attached to different parts or components that move relative to each other due to such mechanical and/or thermal stress, a corresponding relative motion between the connectors occurs, for example between contact pins or contact tabs of one connector and the receiving contacts, for example receiving sockets of the other connector of the connector pair. Such relative motion causes frictional corrosion leading to an impairment of the electrical contact between the pin contacts and the socket contacts.

There is disclosed in EP-A-0492479, an electrical connector comprising a first electrical terminal having a tubular outer member receiving an inner spring member having a forward mating portion for mating with a second electrical terminal of a mating electrical connector, the mating portion of the first terminal being connected to a rearward fixed portion thereof for movement in the tubular outer member.

This capability of axial movement of the mating portion of the first terminal in the tubular outer member, enables the mating portion to follow movement of the second electrical terminal relative thereto, when the connectors are in use under adverse conditions such as those described above. Fretting between the mating portion and the second electrical terminal with which it is mated, is thereby avoided. In the case of this known connector, the inner spring member is primarily intended to be mounted on a circuit board, with the first terminal being upstanding therefrom.

In addition to providing a vibration proof electrical terminal, it is also required to provide that the terminal does not vibrate or chatter within the housing, in which it is situated.

SUMMARY OF THE INVENTION

It is the object of the invention to solve this problem, that is to avoid frictional corrosion even in those connector pairs whose connectors move relative to each other due to loads of the above mentioned kind.

It is a further object of the invention to provide an electrical connector housing which prevents vibration of the terminals therein.

It is a further object of the invention to make a connector having an electrical terminal within a passage and an anti-vibration member for engaging the terminal to prevent terminal chattering within the connector.

It is a further object to make such an electrical terminal sealed from the environment.

According, therefore, to the present invention, an embodiment of an electrical connector of this invention, is characterized in that the first terminal is received in a passage of an insulating housing for mating with the mating connector, the passage having flexible wall sections which are externally depressible towards each other to produce an interference fit between said wall sections and the first terminal.

In one embodiment, the flexible wall sections of the housing are conveniently compressed towards one another by means on the, or each, mating connector, when the connectors are being mated. Such means may comprise camming surfaces on the housing or on the mating connector or upon both of these. Each flexible wall section is preferably provided with an internal recess for receiving a respective detent upon the terminal, better to restrain fretting movement of the tubular outer spring member. Each detent is preferably resiliently compressible by the base of the recess, so that the detent is continuously urged into the recess in the mated condition of the connectors. To this end, each detent may comprise a pair of wings outstanding from the outer member and being separated by a slot. The inner surfaces of the flexible wall sections restrain lateral movement of the outer member.

In another embodiment, an electrical connector is comprised of a main housing portion and a front housing portion. The front housing portion is snap-latchable to the main housing portion, whereby the front housing portion has wall portions extending integrally therefrom to be positioned intermediate terminal receiving platforms of the main housing portion. A locking slide member includes end portions and intermediate rail portions. A secondary locking member extends from each rail portion towards the centerline of the housing, for secondarily locking terminals within the housing. Each rail portion further comprises complementary camming members, such that during transverse movement of the locking slide, the terminals are secondarily locked in position by members, and concurrently, the flexible wall portions are cammed upwardly, thereby moving rubber gasket portions into respective sidewall portions of the terminals, thereby preventing any vibratory movement of the terminals.

Furthermore, the insulating housings of the above embodiments may be provided with latch arms having latching shoulders for engagement with corresponding latching shoulders on the mating connector and means may be provided for urging the latching shoulders of the housing against those of the mating connector in the mated condition of the connectors. Such means may comprise a resilient retainer ring for a sealing grommet in the housing, the ring being resiliently compressed by means on the mating connector in the mated condition of the connectors, better to restrain relative movement therebetween.

There is disclosed in GB-A-1196099, a one piece moulded electrical connector housing for mating with a mating electrical connector, the housing comprising a body having a forward mating face, a rear face, at least one terminal receiving passage opening into said faces and a forwardly directed hood for receiving a mating portion of the mating connector, coplanar latch arms extending from the housing in the forward direction thereof each terminating in a latching head with a rearwardly facing latching shoulder for engaging a corresponding latching shoulder of the mating connector, the latch arms being resiliently deflectable between a normal position and a latching position.

In this known connector housing, the latch arms are connected to opposite sides of the housing in offset relationship thereto, and are unprotected so that a lead extending from a terminal in the, or each, passage in the housing may, when the housing has been loaded with terminals connected to leads, tangle with the latch arms when the loaded connector housing is being handled, and the latch arms are susceptible to damage during handling of the housing.

Therefore, an electrical connector housing of the above configuration or any other configuration that could incorporate latch arms, may be characterized in that the latch arms comprise at least one pair of latch arms joined together towards the rear face of the housing by a resilient strap connected to the housing body to provide a pivot point about which the latch arms are deflectable between said normal and latching positions, the latching heads projecting beneath a side wall of the hood and the remainder of the latch arms being substantially coplanar with said side wall, whereby the latch arms are in line with the housing.

By virtue of the in-line location of the latch arms, the latch arms are protected, leads cannot tangle therewith and the moulding of the one piece housing is facilitated.

The resilient strap is preferably substantially U-shaped and thus comprises a pair of legs connected by a bight, each leg being connected at its end remote from the bight to the rear end portion of a respective latch arm and the centre of the bight being connected to the housing body to provide the pivot point. Thus the U-shaped strap may be conveniently accommodated between the rear portions of the latch arms in coplanar relationship therewith.

The rear ends of the latch arms may be protected by means of a frame connected to the housing body.

In the normal position of the latch arms, the latching heads are preferably proximate to each other, each latch head terminating in an inclined ramp surface, these ramp surfaces being oppositely inclined. Thus the mating electrical connector may be provided with a single latching member for engaging the ramp surfaces to cam the latch arms apart to enable the latch arms to resile so that the latching shoulders of the latching heads of the latch arms engage behind a latching shoulder of the latching member.

Further to enhance the ready mouldability of the housing, the hood may be provided with a recess allowing access to a core pin for forming the latching heads of the latch arms. The recess in the hood may also serve to provide access to the core pin for forming a notch in a part of the housing underlying the hood, for engagement by a latch member on a retaining ring for retaining a sealing grommet on said underlying part of the housing.

DETAILED DESCRIPTION OF THE PREFERRED EMBODIMENT

Figure 1:
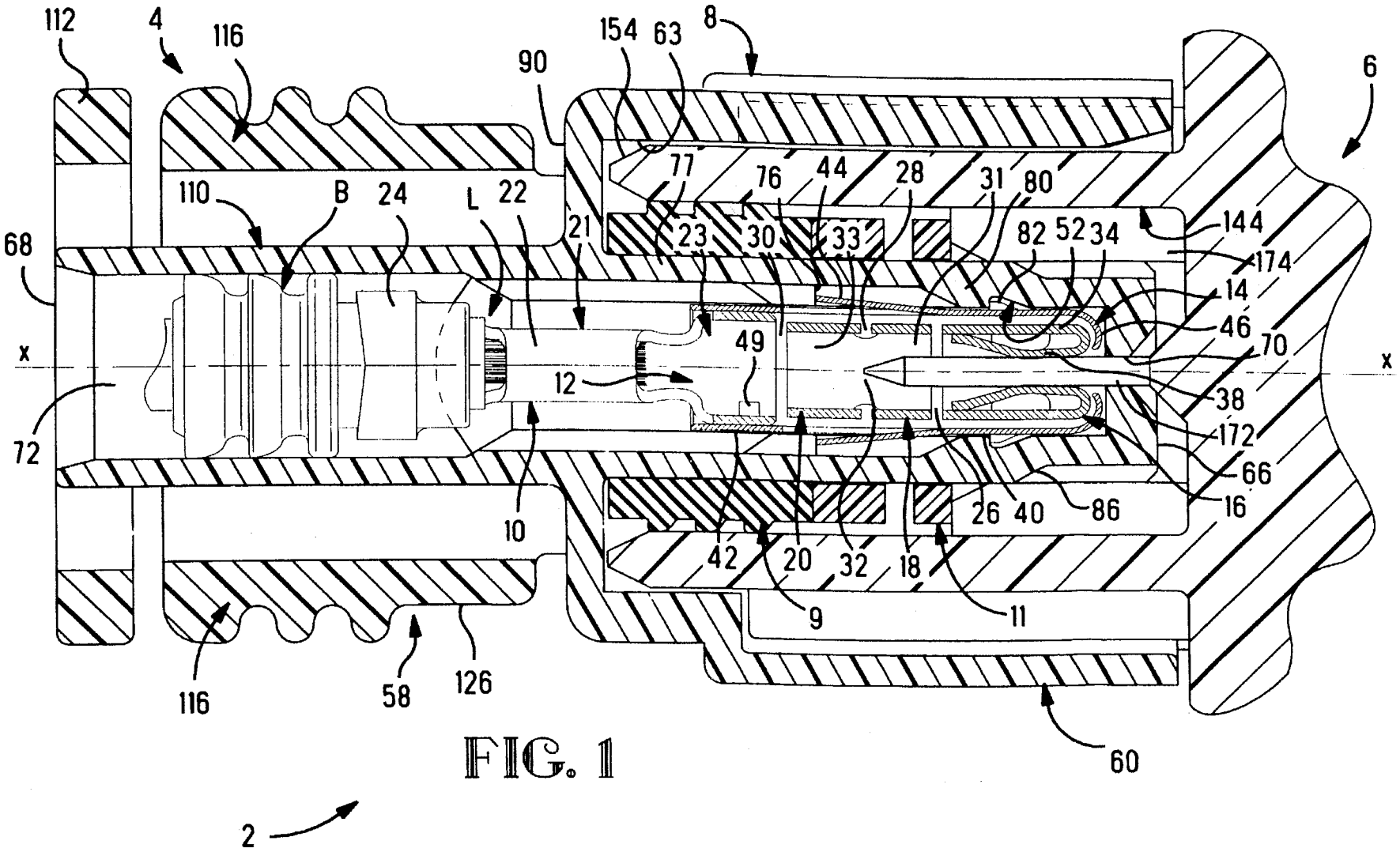
FIG. 1 is a longitudinal sectional view of a sealed, vibration proof, electrical connector assembly comprising an electrical receptacle connector mated with an electrical pin connector.

As shown in FIG. 1, a sealed, vibration proof electrical connector assembly 2 comprises an electrical receptacle connector 4 and an electrical pin connector 6. The assembly 2, may, when in use, serve to connect a pair of insulated electrical leads L (only one of which is shown) to sensors (not shown) incorporated in the pin connector 6, in the engine compartment of an automotive vehicle and thus in a vibratory and temperature cycling environment.

The receptacle connector 4 comprises an insulating housing 8, a pair of electrical receptacle terminals 10 (only one of which is shown), an elastomeric grommet 9 and a grommet retaining ring 11. Each terminal 10 comprises an inner spring member 12 and an outer spring member 14.

Figure 5:
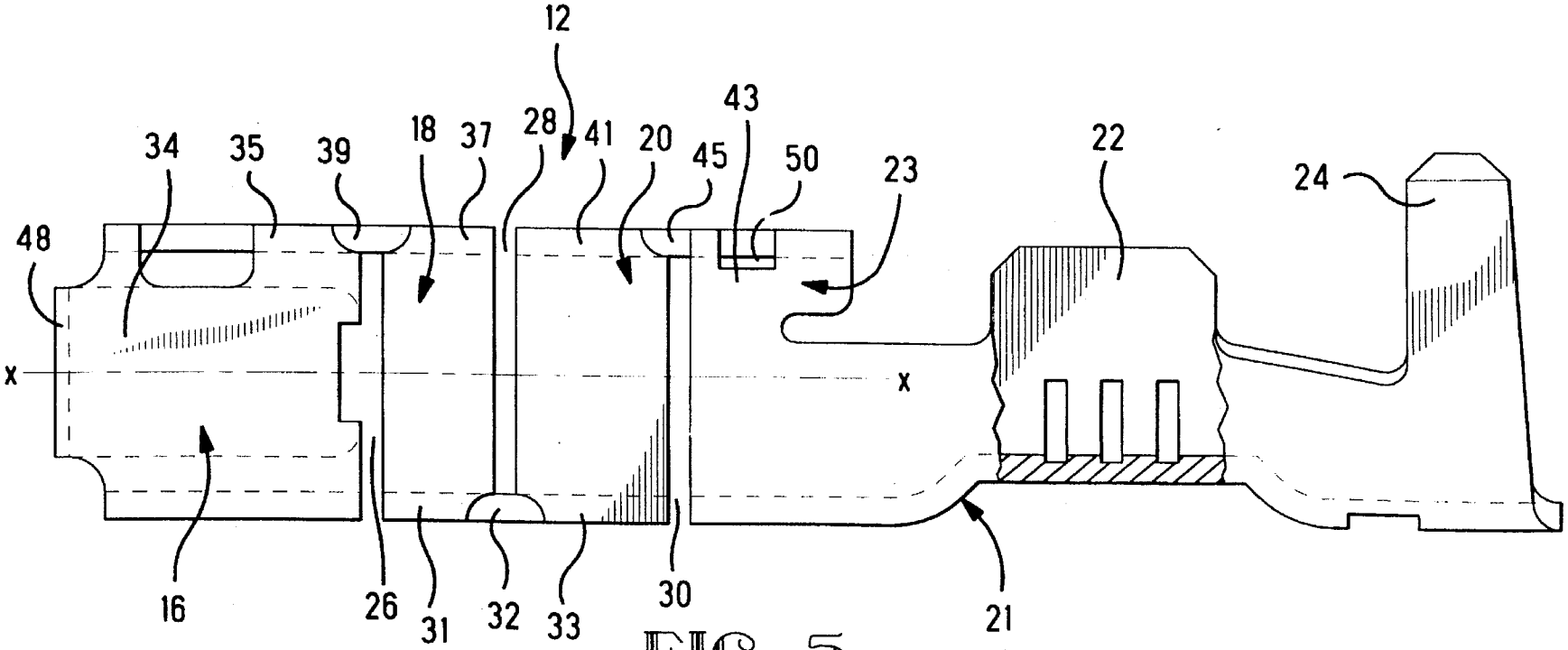
FIG. 5 is an enlarged side view of an inner spring member of an electrical terminal of the receptacle connector.

The inner spring member 12 will now be described with particular reference to FIGS. 1, 2 and 5. The inner spring member 12 which has been stamped and formed from a single piece of sheet metal stock, comprises a forward, pin receptacle box portion 16, intermediate box portions 18 and 20, respectively, and a lead connecting rear portion 21. The portion 21 comprises a box portion 23 and a crimping ferrule having a wire barrel 22 crimped about the metal core of the respective lead L, and an insulation barrel 24 crimped about a bung seal B surrounding the insulation of the lead L as shown in FIG. 1. The crimping ferrule is shown in its uncrimped condition in FIG. 5. The portions 16, 18, 20 and 23 are of substantially rectangular cross section. At the ends of the portions 16 and 18, which are proximate to each other, three side walls of each of the portions 16 and 18 co-operate to define a peripheral slot 26. At the ends of the portions 18 and 20, which are proximate to each other, three side walls of each of these portions co-operate to define a peripheral slot 28. At the ends of the portions 20 and 23, which are proximate to each other, three side walls of each of the portions 20 and 23 co-operate to define a peripheral slot 30. The remaining side wall 31 of the portion 18 is connected to the remaining side wall 33 of the portion 20 by a first web 32, the remaining side walls 35 and 37 of the portions 16 and 18 being connected by a second and similar web 39 and the remaining side walls 41 and 43 of the portions 20 and 23 being connected by a third and similar web 45. The box portions 16, 18 and 20 are, by virtue of the slots 26, 28 and 30 relatively moveable on the webs 32, 39 and 45, respectively (in relation to the box portion 23 which is fixed, as described below), so that the receptacle portion 16 is displaceable along the longitudinal axis X—X of the inner spring member 12, as well as transversely of the axis X—X, in accordance with the general teaching of EP-A-0492479, the disclosure of which is incorporated herein by reference.

Opposite side walls 34 of the box portion 16 have extending from their forward edges, bights 48 from which in turn extend re-enterant contact springs 36 having opposed, inwardly bowed contact surfaces 38 within the receptacle box portion 16.

The outer spring member 14, which has been stamped and formed from a single piece of sheet metal stock, is of rectangular cross section corresponding to that of said box portions. The outer spring member 14 encloses the box portions 16, 18, 20 and 23 of the inner spring member 12. The outer spring member 14 has a first pair of opposite side walls 40 and a second pair of opposite side walls 42 (only one of which is shown) which are adjacent to the side wall 40. A resilient, rearwardly directed latching tongue 44 stamped out from each of the side walls 40, extends obliquely away therefrom. At the forward end of the spring member 14, arcuate extensions 46 of the side walls 40 overlie the bights 48 of the inner spring member 12, to limit forward movement of the receptacle box portion 16. The outer spring member 14 is fixed to the inner spring member 12 by means of tabs 49 (only one of which is shown, in FIG. 1), sheared from the rearward end portions of the side walls 42 and which have been clinched into respective slots 50 (FIG. 5) in the box portion 23 of the spring member 12. The spring member 12 is thus secured in the outer spring member 14 such that the box portions 16, 18 and 20 can move within the spring member 14 in the direction of the axis X—X.

Figure 2:
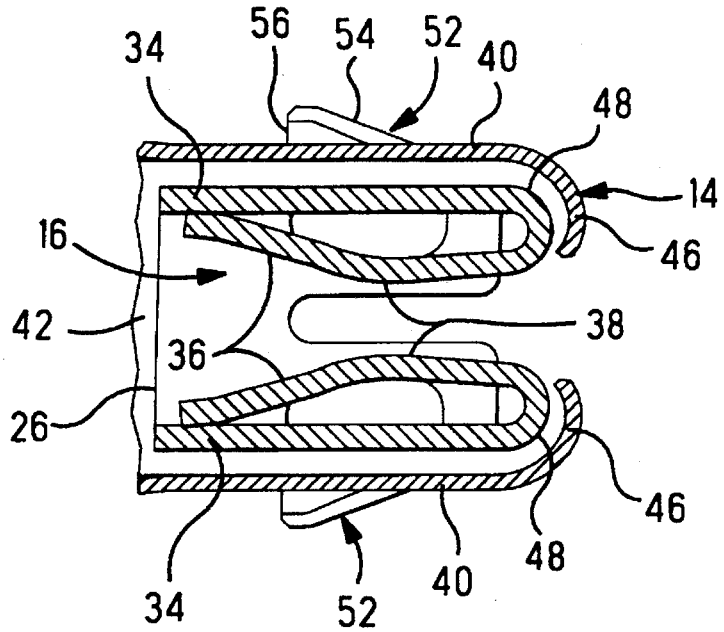
FIG. 2 is an enlarged, fragmentary view of a detail of FIG. 1.
Figure 3:
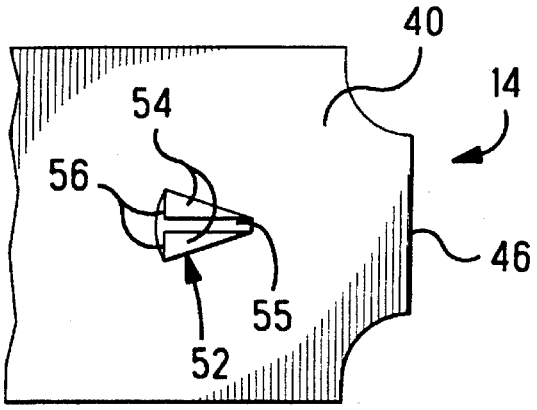
FIG. 3 is a plan view of the detail shown in FIG. 2.

Each side wall 40 of the outer spring member 14 has stamped out therefrom, about midway between the respective latching tongue 44 and extension 46, an antifretting detent 52 which is best seen in FIGS. 2 and 3. Each detent 52 is shaped substantially as an acute angled triangle, as seen in plan view, and comprises a pair of resiliently depressible wings 54 each of which is shaped substantially as a right angle triangle as seen in plan view. The inner edges of the wings 54 are slightly spaced from each other to define a central slot 55. The apex of said acute angled triangle is directed towards the extension 46 and its base is directed towards the latching tongue 44. Each wing 54 has an arcuate free base edge 56 remote from said apex, so that as seen in the direction of the extension 46, the detent 52 has an end view profile which is substantially of half moon shape.

Figure 6:
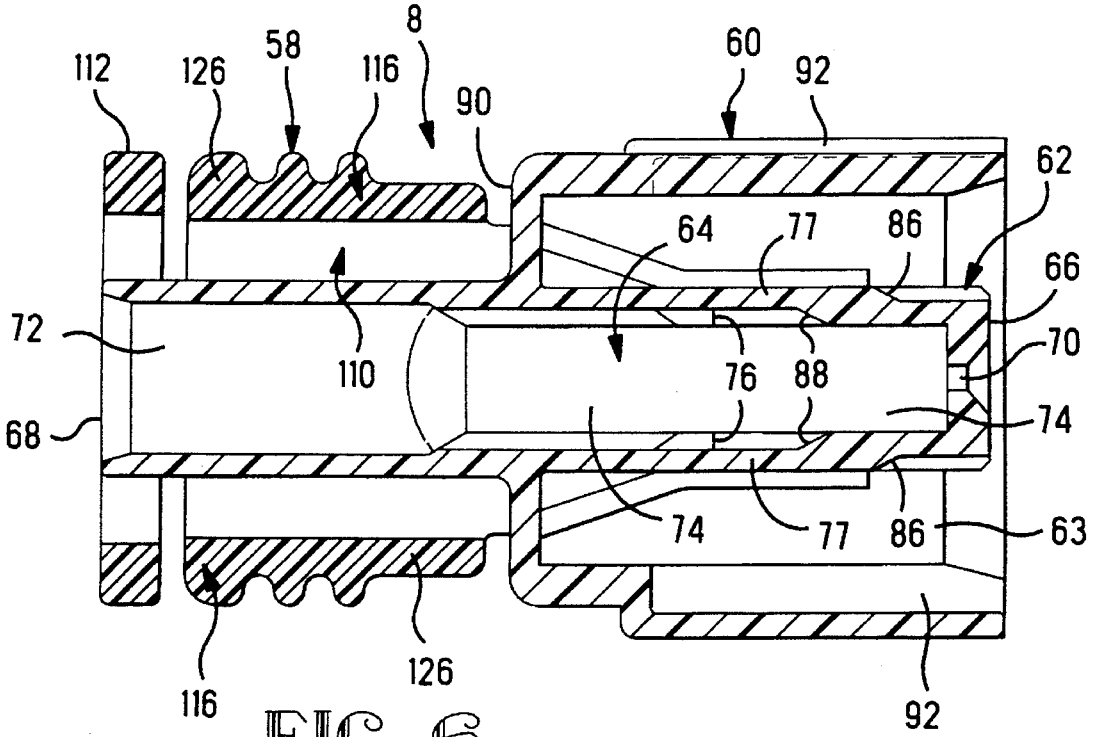
FIG. 6 is a longitudinal sectional view of an insulating housing of the receptacle connector.
Figure 7:
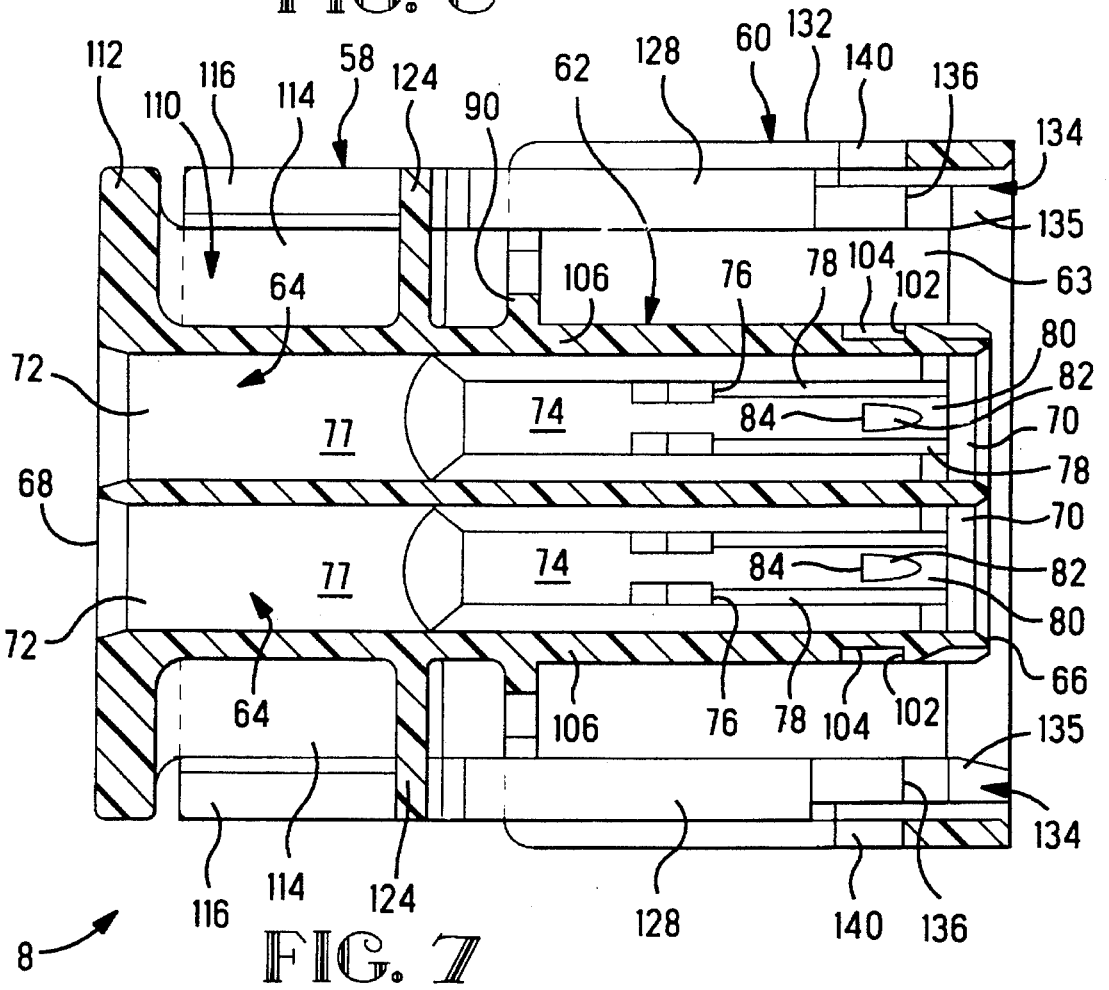
FIG. 7 is a longitudinal sectional view of the housing shown in FIG. 6 having been taken at right angles to the view shown in FIG. 6.
Figure 8:
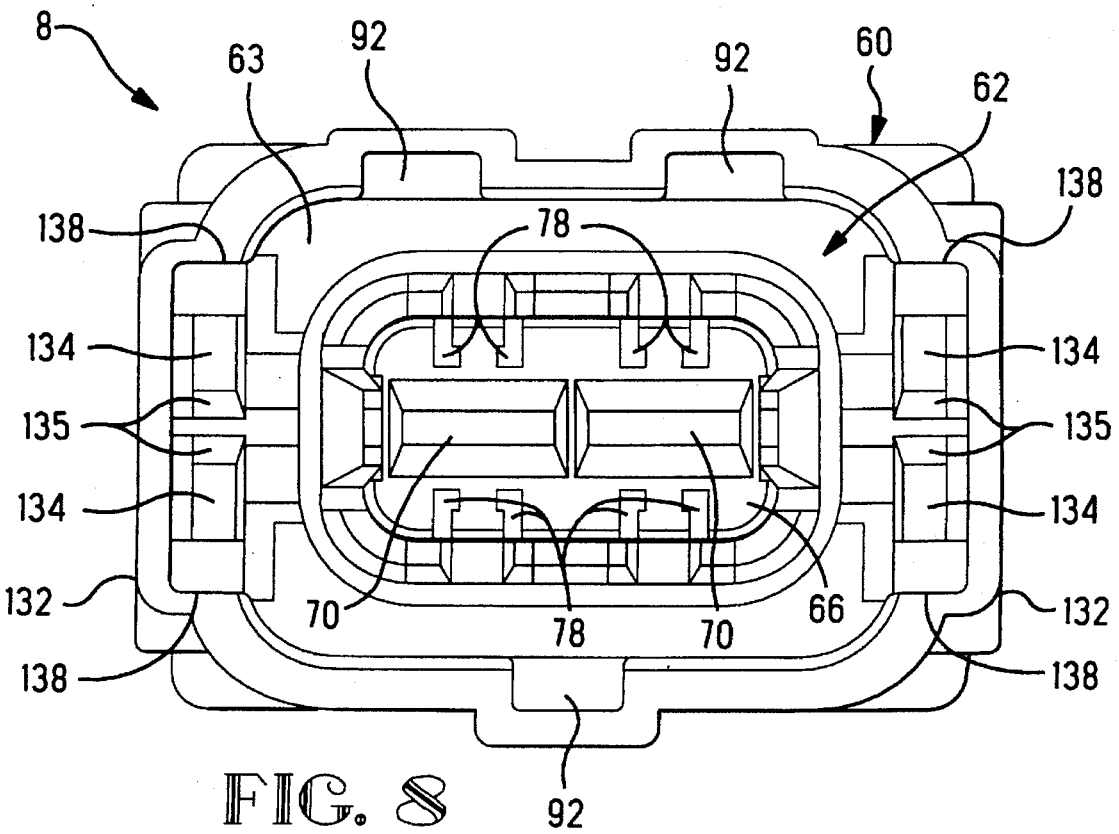
FIG. 8 is a front end view of the housing of the receptacle connector, drawn to a reduced scale.

The housing 8 of the receptacle connector 4, which has been moulded in one piece, will now be described with particular reference to FIGS. 4 and 6 to 10. The housing 8 basically comprises a body 58 to which is connected a forward hood 60, into which a forward part 62 of the body 58 projects, a peripherally continuous socket 63 being defined between the hood 60 and the forward part 62. There extend through the body 58, a pair of terminal receiving passages 64, each of which opens into a terminal receiving face 68 of the body 58 and into a mating face 66 thereof by way of pin receiving mouth 70. Each passage 64 comprises a rear part 72 in which the bung seal B of the respective terminal 10 is tightly engaged in sealing tight fashion as shown in FIG. 1, and a forward rectangular cross section part 74 extending into the hood 60. The forward part 74 of each passage 64 has therein opposed shoulders 76 each of which is engaged by a respective latching lance 44 of the outer spring member 14. The terminals 10 are thereby restrained against withdrawal from the passages 64. Rearwardly of the shoulders 76, the rear part of each outer spring member 14, enclosing the box portion 23 of the spring member 12, is snugly received in the part 74 of each passage 64. Forwardly of the shoulders 76, opposite side walls 77 of each passage part 74 are each formed with a pair of slots 78 (FIGS. 7, 8 and 9) so that a section 80 of each wall 77, between the respective pair of slots 78 is resiliently flexible inwardly of the respective passage part 74. As shown in FIG. 8, the slots 78 have L-cross section, blind portions opening into the mating face 66. Each wall section 80 thereby constitutes a flexible beam supported at both of its ends. Each side wall section 80 has a forwardly tapered recess 82 for receiving a respective antifretting detent 52 and terminating rearwardly in a shoulder 84. Opposite to each recess 82, the outer surface of each wall section 80 is formed with a ramp surface 86 (FIGS. 1 and 6) and is of increased thickness between the surface 86 and an inclined internal surface 88 of the wall section 80. The hood 60 is formed with internal keyways 92.

Figure 9:
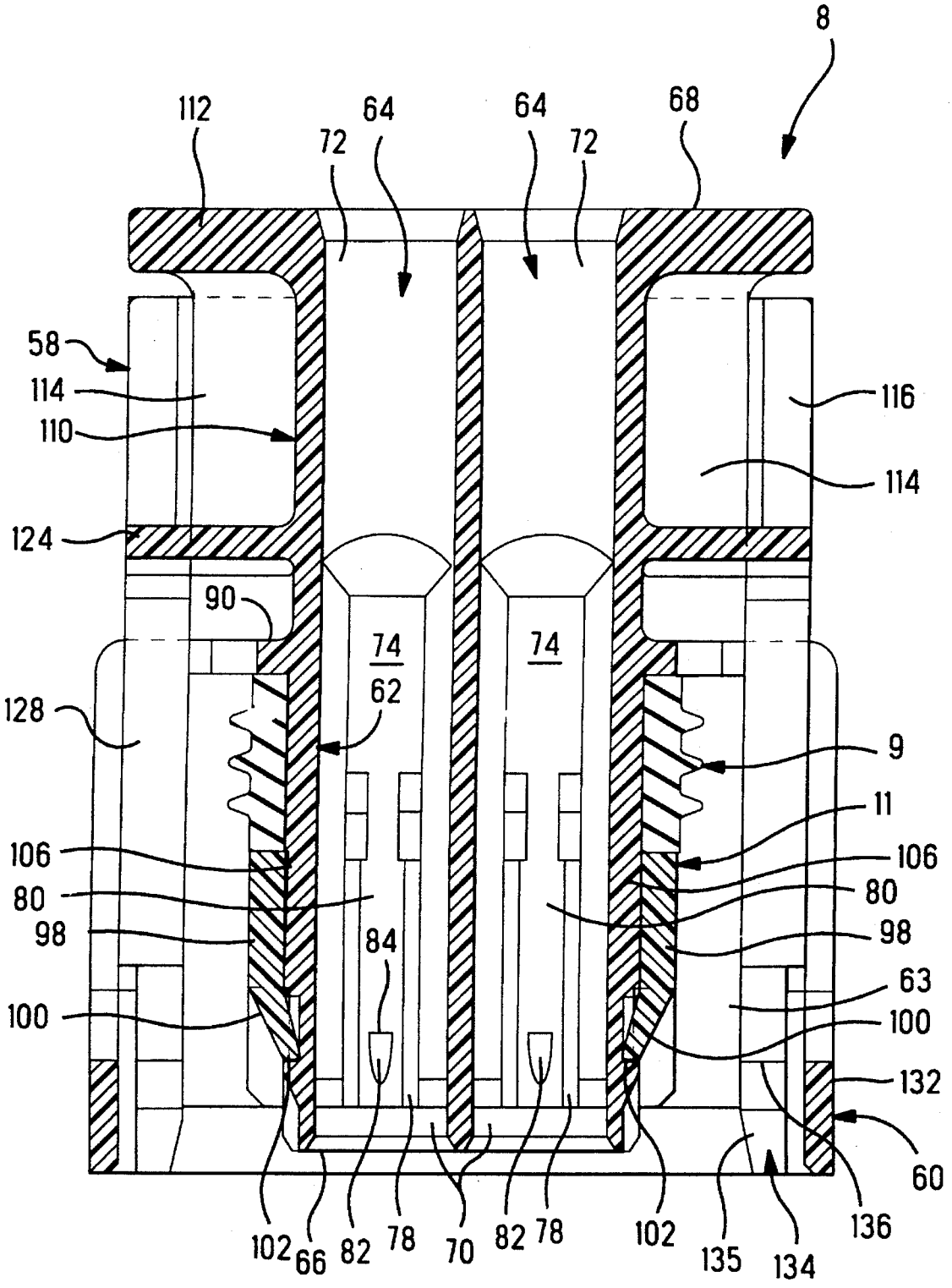
FIG. 9 is a similar view to that of FIG. 7 drawn to the same scale as FIG. 8 and showing a sealing grommet and a retaining ring assembled to the housing.
Figure 11:
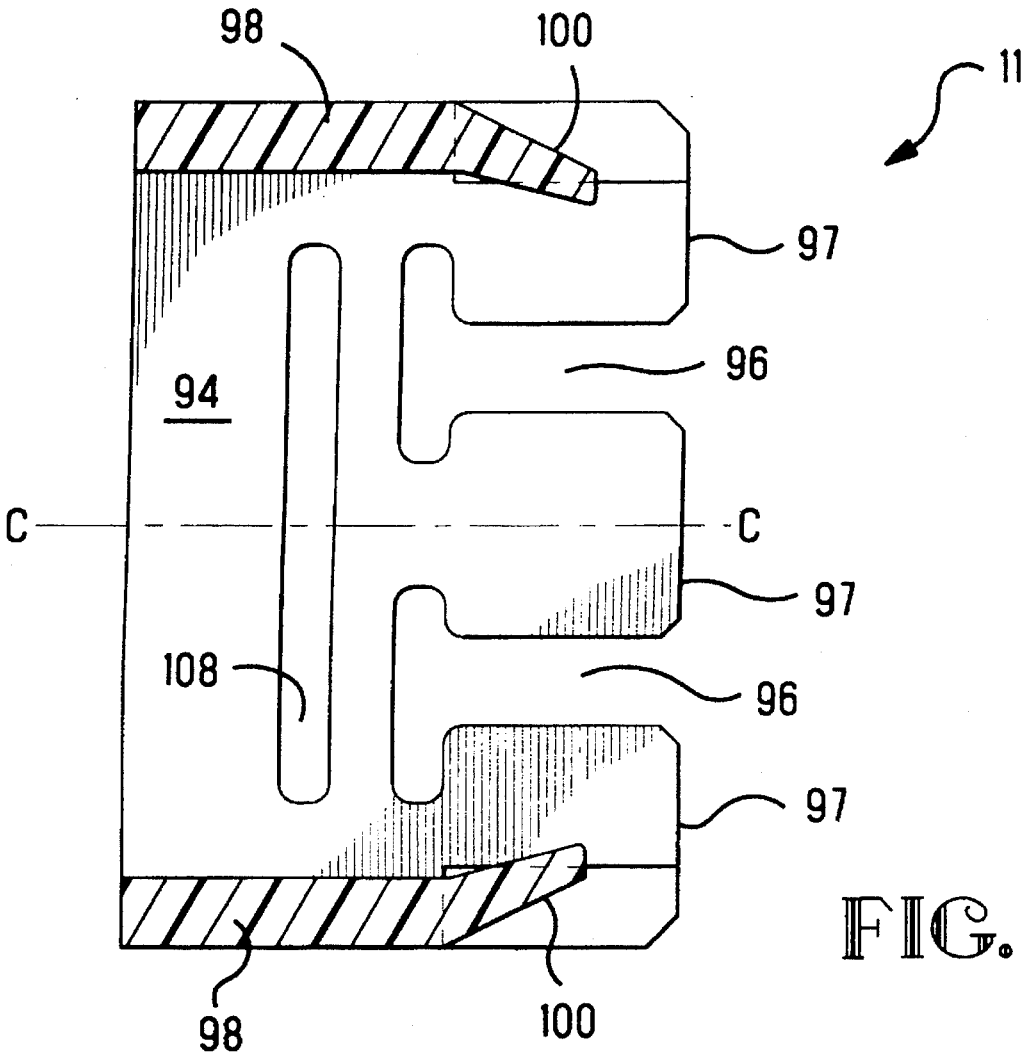
FIG. 11 is an axial sectional view of the retaining ring.
Figure 13:
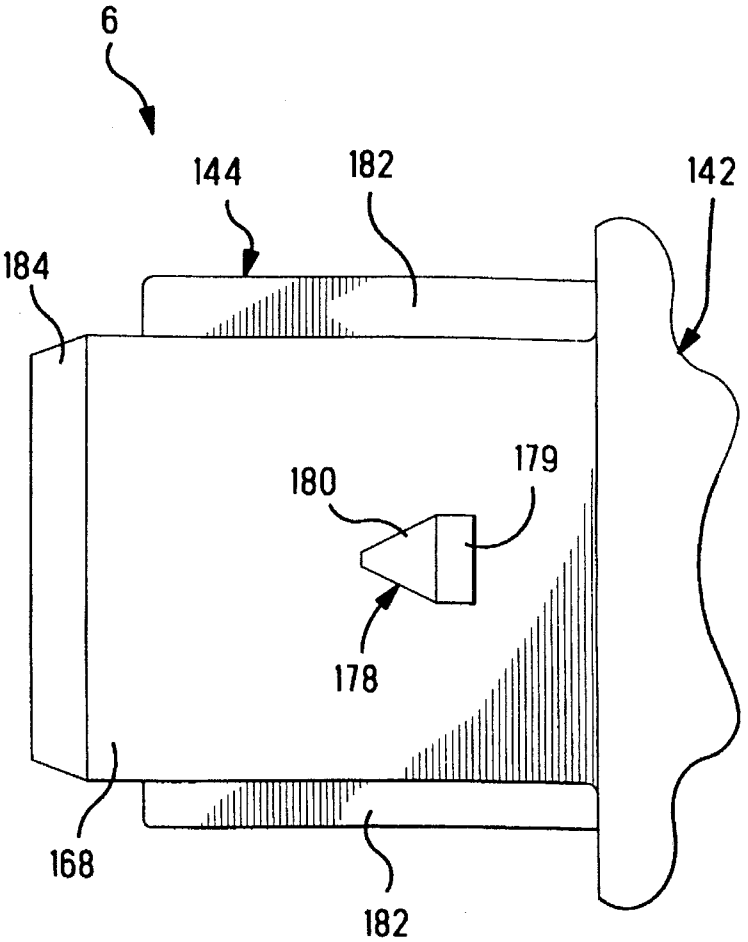
FIG. 13 is a fragmentary side view of the pin connector.
Figure 12:
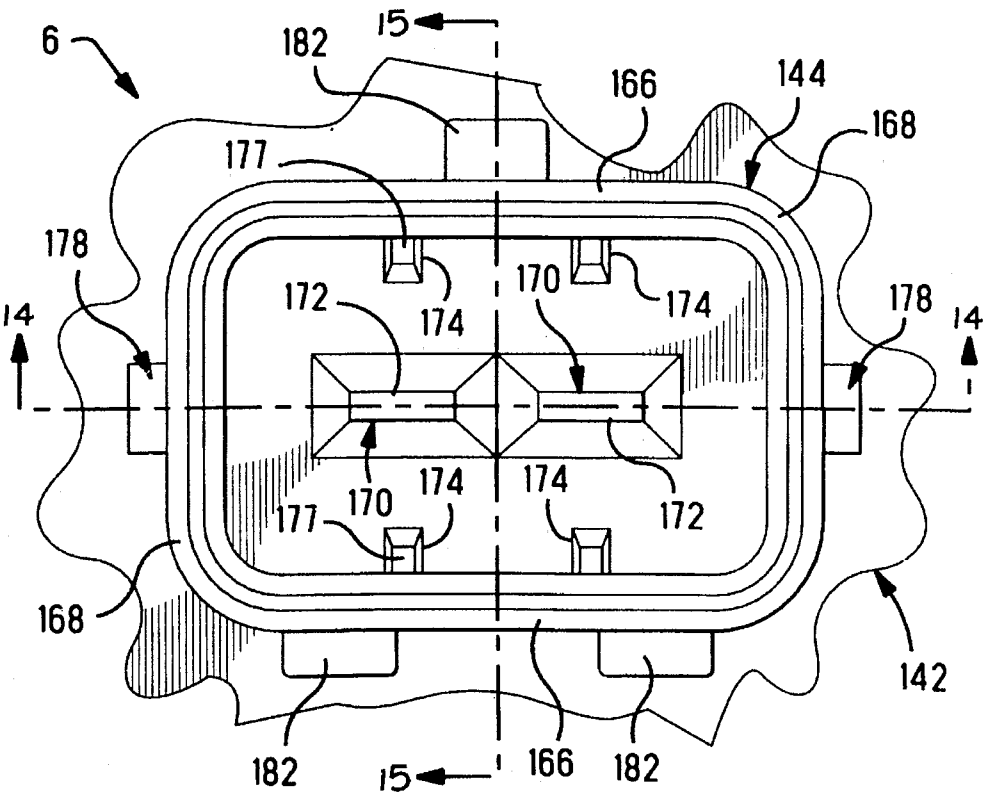
FIG. 12 is a fragmentary front view of the pin connector.

As shown in FIGS. 1 and 9, the sealing grommet 9 surrounds the forward part 62 of the body 58 of the housing 8 and is engaged between the rear wall 90 of the hood 60 and the grommet retaining ring 11. The grommet retaining ring 11 (FIGS. 1 and 11), which is annular and is of substantially rectangular cross section comprises first opposed side walls 94 each having therein slots 96 opening into a forward edge 97 of the wall 94. The ring 11 has second opposed side walls 98 each having an inwardly inclined latching tongue 100, the free end of which latchingly engages a shoulder 102 (FIGS. 7 and 9) provided by an external notch 104 in a respective side wall 106 of the forward part 62 of the housing body 58. Returning to FIG. 11, each side wall 94 of the ring 11 is formed with a rectilinear transverse slot 108 to enhance the resilience of the retaining ring 11 in the direction of its central axis C—C.

Figure 4:
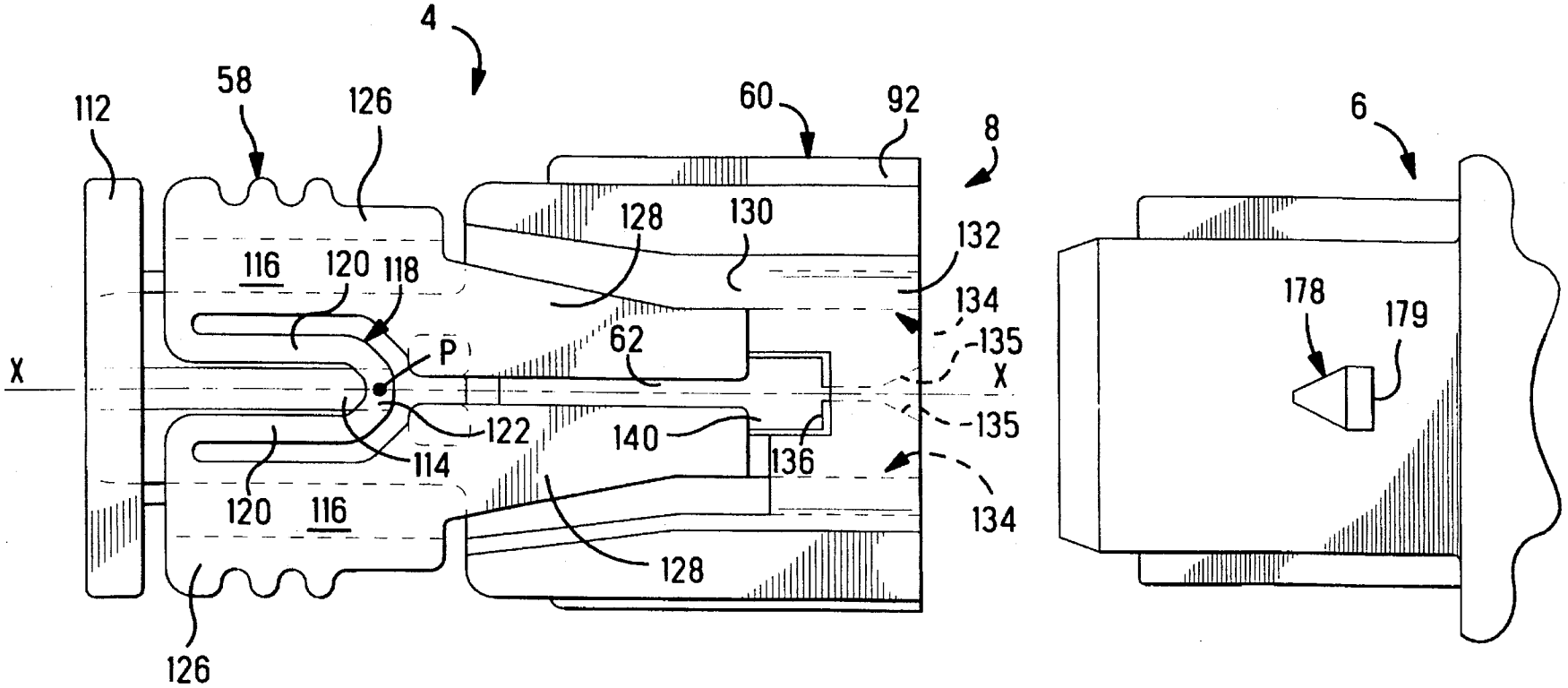
FIG. 4 is a side view of the receptacle connector.
Figure 10:
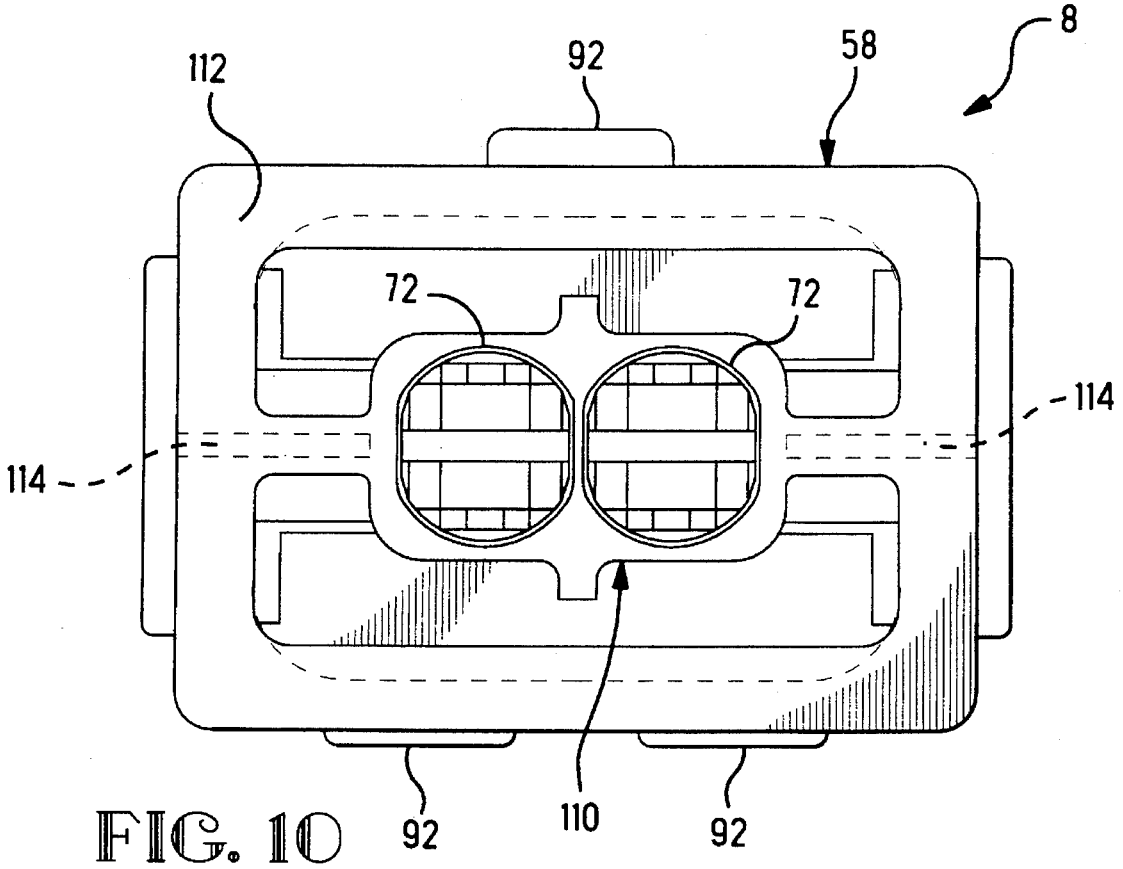
FIG. 10 is a rear end view of the housing drawn to the same scale as FIGS. 8 and 9.

As shown in FIGS. 9 and 10, the body 58 of the housing 8 comprises a rectangular rear portion 110 defining the rear part 72 of each terminal receiving passage 64, and a rectangular rear frame 112 connected to the rear portion 110 by longitudinal struts 114 and surrounding the rear end of the portion 110. On each side of the rear portion 110 of the body 58 is a pair of latch arms 116, best seen in FIG. 4, which are connected together by means of a resilient, U-shaped spring strap 118 comprising legs 120 connected at their forward ends by a bight 122. The centre of the bight 122 of each strap 118 is connected to the respective strut 114 by way of a lateral stub 124 extending therefrom (FIG. 7). The rear end of each leg 120 is connected to the rear end of a respective latch arm 116. The stub 124 provides a pivot point P (FIG. 4) about which the legs 120 are pivotable, the stub 124 being the sole connection between the strap 118 and the remainder of the housing 8. The latch arms 116 are not connected to the housing 8 at all, excepting by way of the strap 118. Each latch arm 116 comprises a rear handle 126 from which projects forwardly, a shank 128 into a rearwardly opening recess 130 in a side wall 132 of the hood 60. Each latch arm 116 of each pair of these arms is, as a whole, coplanar with the hood side wall 132 and with the other latch arm of the pair, whereby the latch arms 116 do not project from the housing 8 but are substantially in line therewith. At its forward end, each latch arm shank 128 has a latching head 134 protruding beneath the respective side wall 132 of the hood 60 (FIGS. 7 to 9), and projecting inwardly towards the latching head 134 of the other latch arm of the pair. Each latching head 134 has a forwardly inclined ramp surface 135 and a rearwardly facing latching shoulder 136. The latch arms 116 have a normal closed, latching position as shown in FIG. 4, in which the latching heads 134 of the latch arms 116 of each pair are proximate to each other. The latch arms 116 can be pivoted to an open position in which the latching heads 134 are more widely spaced from each other, by pressing the handles 126 of the latch arms 126 of the pair towards each other. Upon release of the handles 126, the latch arms 116 resile to their normal position by virtue of the resilience of the straps 118. Overstress of the latch arms 116 when they are pivoted to their open position is prevented by shoulders 138 (FIG. 8) of the hood 60, bounding the hood side walls 132 to limit outward movement of the latching heads 134. Each side wall 132 of the hood 60 has a rearwardly opening rectangular recess 140 (FIG. 4) to allow access for a core pin (not shown) for moulding the latching shoulders 136 and for providing the notch 104 in the respective side wall 106 in the forward part 62 of the housing 8; as will best be appreciated from FIG. 7.

Figure 15:
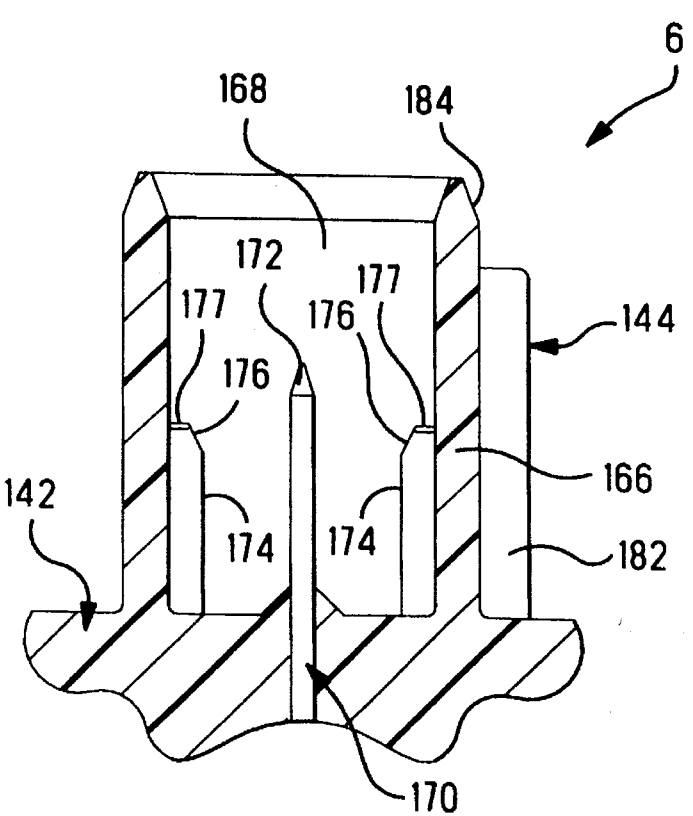
FIG. 15 is a view taken on the lines 15—15 of FIG. 12.
Figure 14:
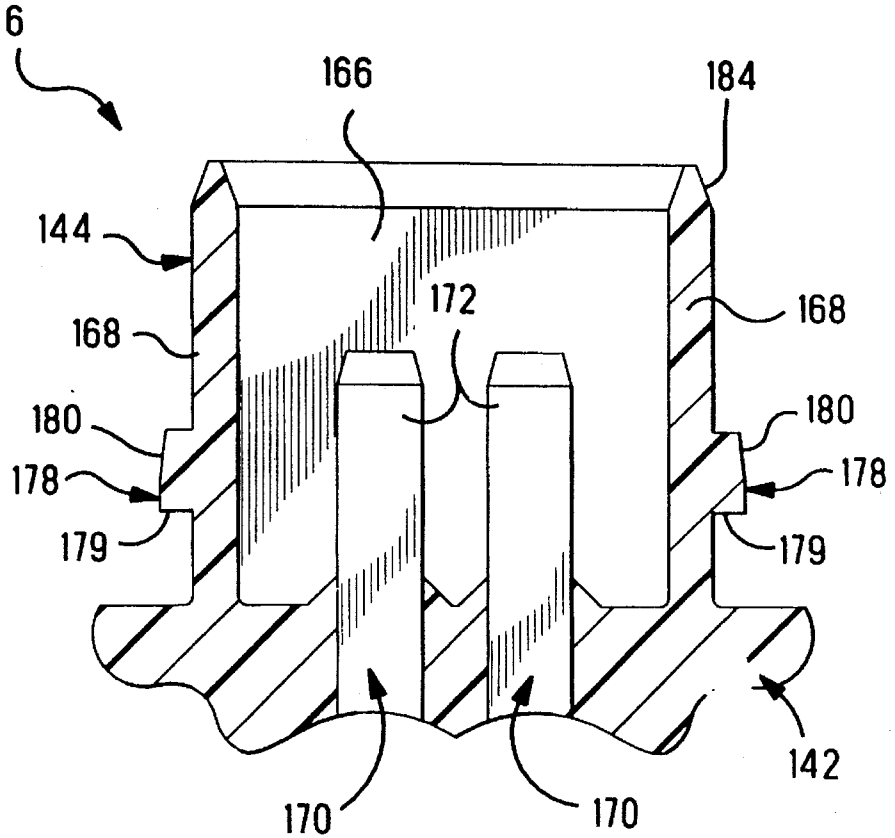
FIG. 14 is a view taken on the lines 14—14 of FIG. 12.

The pin connector 6 will now be described with reference to FIGS. 12 to 15. The connector 6 comprises an insulating housing 142, shown in fragmentary form, which may contain sensors for connection to the leads L of FIG. 1. There projects from the housing 142, a substantially rectangular cross section hood 144 for mating reception in the socket 63 of the connector 4. The hood 144 is defined by a first pair of opposed side walls 166 and a second pair of opposed side walls 168. A pair of terminal pins 170 in the housing 142 have mating end portions 172 projecting into the hood 144 for mating with respective receptacle terminals 10 of the connector 4. The terminal pins 170 are connected to the sensors, for example, by means not shown. Each side wall 166 has a pair of spaced camming ribs 174 projecting into the hood 144 and terminating in camming faces 176, as best seen in FIG. 15, for cooperation with respective ramp surfaces 86 of the housing 8 (FIGS. 1 and 6). The ribs 174 have flat free ends 177. Each rib 174 on one wall 166 is opposite to and is aligned with a corresponding rib 174 on the opposite wall 166. Each wall 168 has a central external latch member 178 having a rear latching shoulder 179 and a tapered camming nose 180 (FIG. 13) for cooperation with respective latching heads 134 of the housing 8. The walls 166 have external keys 182 for reception in respective keyways 92 of the housing 8 (FIG. 8). Each wall 166 and 168 has a chamfered free edge 184 for guiding it into the socket 63 of the connector 4.

The connector 6 is mated with the connector 4 by inserting the hood 144 of the connector 6 into the socket 63 of the connector 4 as shown in FIG. 1, each key 182 slidably engaging in a respective keyway 92 of the housing 8. During the mating operation, the mating portion 172 of each pin 170 enters the mouth 70 of a respective terminal receiving passage 64 and is received between the contact surfaces 38 of the contact springs 36 of the terminal 10 in the passage 64. The inner surfaces of the side walls 166 and 168 of the connector 6 engage the sealing grommet 9 in sealing tight relationship therewith. Also during the mating operation, the camming face 176 of each camming rib 174 of the connector 6, engages against the respective ramp surface 86 of the housing 8 thereby camming the underlying wall section 80 resiliently inwardly by virtue of the slots 78, against the respective side wall 40 of the respective spring member 14,and the detent 52 thereon, the detent 52 being received in the respective recess 82 and being resiliently depressed to some extent, by the bottom wall of the recess 82. The free edge 56 of each wing 54 of the detent 52 engages the rear wall of the recess 82. An interference fit is thereby produced between the wall sections 80 and the outer spring member 14. Further during the mating operation, the camming nose 180 of each latch member 178 engages between the latching heads 134 of a respective pair of the latch arms 166 thereby camming them apart against the action of the respective spring strap 118 until, as the connectors 4 and 6 reach their mated position, the arms 116 resile as the shoulders 179 of the latch members 178 pass the latching shoulders 136 of the heads 134 so that the shoulders 136 are carried inwardly to latch against the shoulders 179 thereby securing the connectors 4 and 6 in their mated relationship. The shoulders 179 are drawn tightly against the shoulders 136 because the flat free ends 177 of the camming ribs 174 resiliently and axially compress the sealing grommet retaining ring 11 by virtue of the slots 108 therein, given that the grommet 9 having been compressed between the side walls 116 and 118 of the hood 114 will have little axial resilience.

As mentioned above, the connector assembly 2 comprising the connectors 4 and 6, is intended for use in a vibratory and temperature cycling environment, for example in the engine compartment of an automotive vehicle. Fretting and consequent frictional corrosion of parts of the connector assembly 2, which are susceptible to a fretting action, must, therefore, be avoided. Fretting between the pins 170 and the contact surfaces 38 of the contact springs 36 is avoided, because the pin receptacle portion 16 of each inner spring member 12 can move both axially and laterally in its outer spring member 14. Fretting between the outer spring member 14 and the housing 8 is prevented by virtue of the interference fit between the wall sections 80 and the spring member 14. Also, relative movement between the connectors 4 and 6 is restrained because the grommet retaining ring 11 urges the latching shoulders 179 firmly against the latching shoulders 136.

Since the latch arms 116 are in line with the housing 4 and so do not project therefrom, the moulding of the housing 4 as a one piece item, is simplified, and the latch arms are not free to tangle with the leads L so as to be damaged, when the terminals 10 are being loaded into the housing 4 or during the assembly of the connectors 4 and 6. The connectors 4 and 6 can be released from each other by pressing the handles 126 of each pair of latch arms towards each other.

Figure 18:
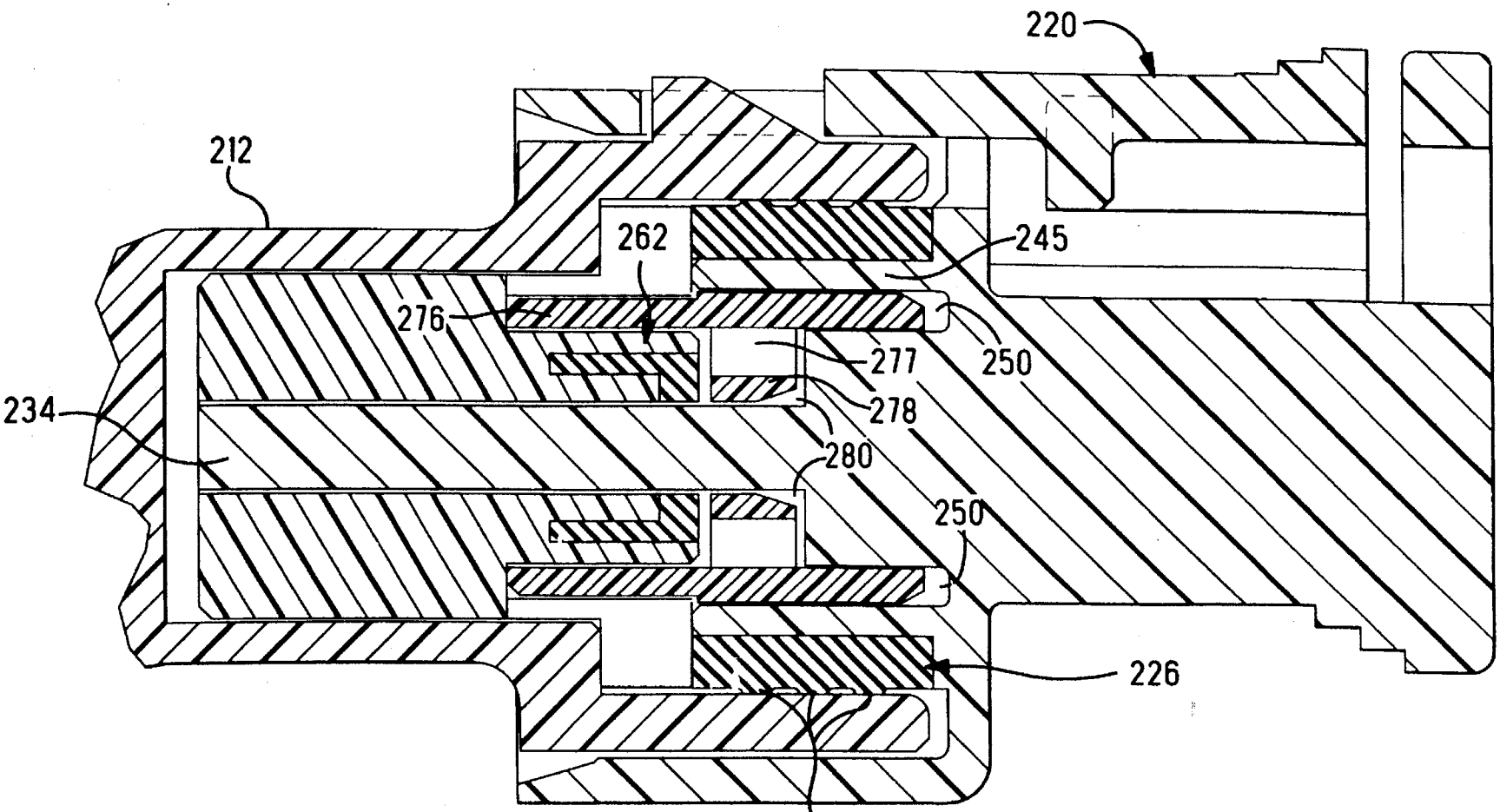
FIG. 18 is a cross sectional view through lines 18—18 of FIG. 16.
Figure 19:
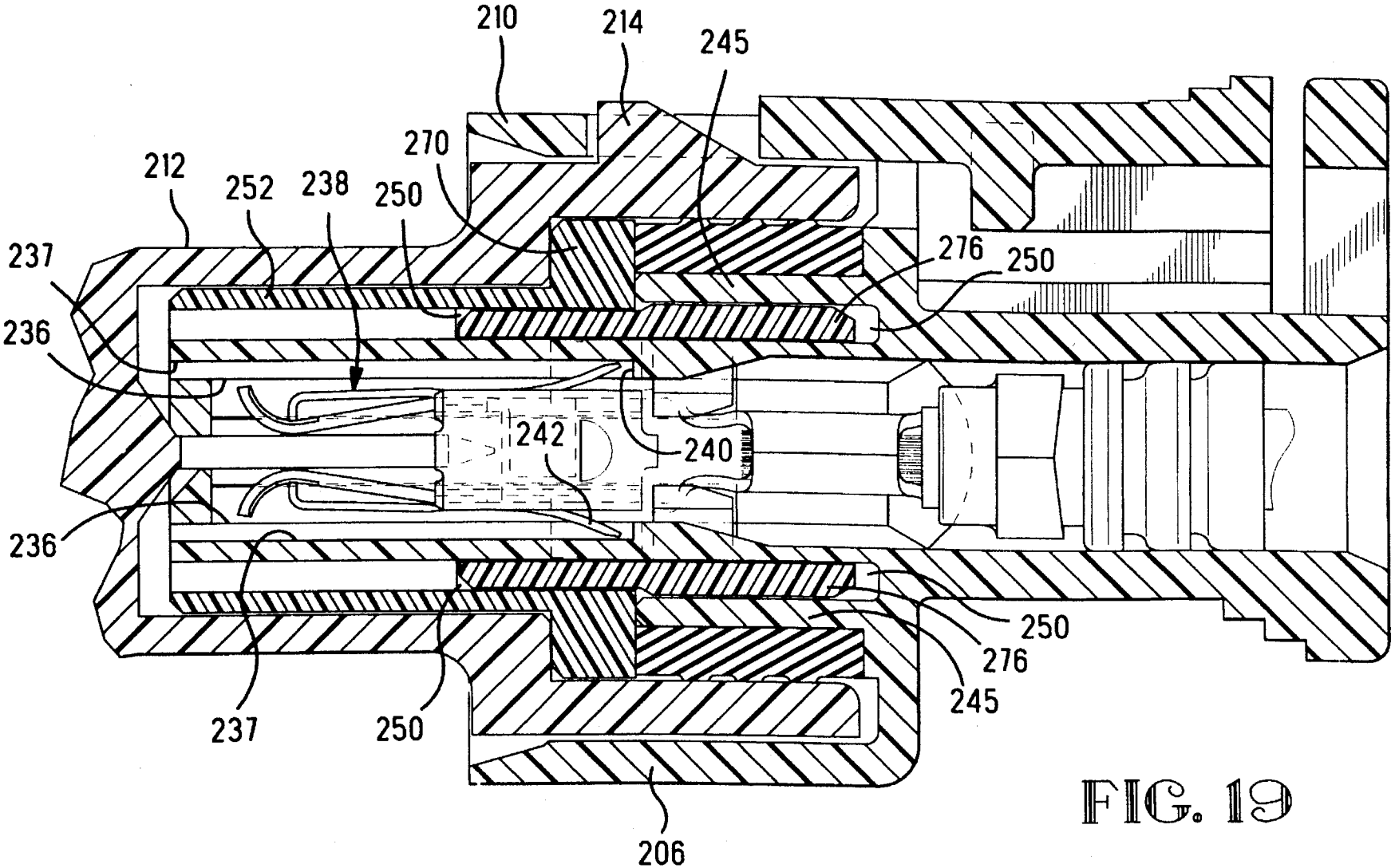
FIG. 19 is a cross sectional view through lines 19—19 of FIG. 16.

An alternative embodiment of an electrical connector of the present invention is shown in FIGS. 16–24. With respect first to FIGS. 16 and 17, an electrical connector housing is shown generally at 200 and includes a front mating portion 204, an outer shroud portion 206, a rear face 208 and a pivotable latch portion at 210. The electrical connector housing 200 is comprised of four main components a rear housing portion 220, a front housing portion 222, a locking slide 224, and a peripheral seal 226. The electrical connector housing 200 is of the type that is matable with a complementary connector member 212, for example as shown in FIG. 19, where the latch member 210 is cooperable with a latching lug 214 on the connector housing 212 to lock the two connectors together.

Figure 20:
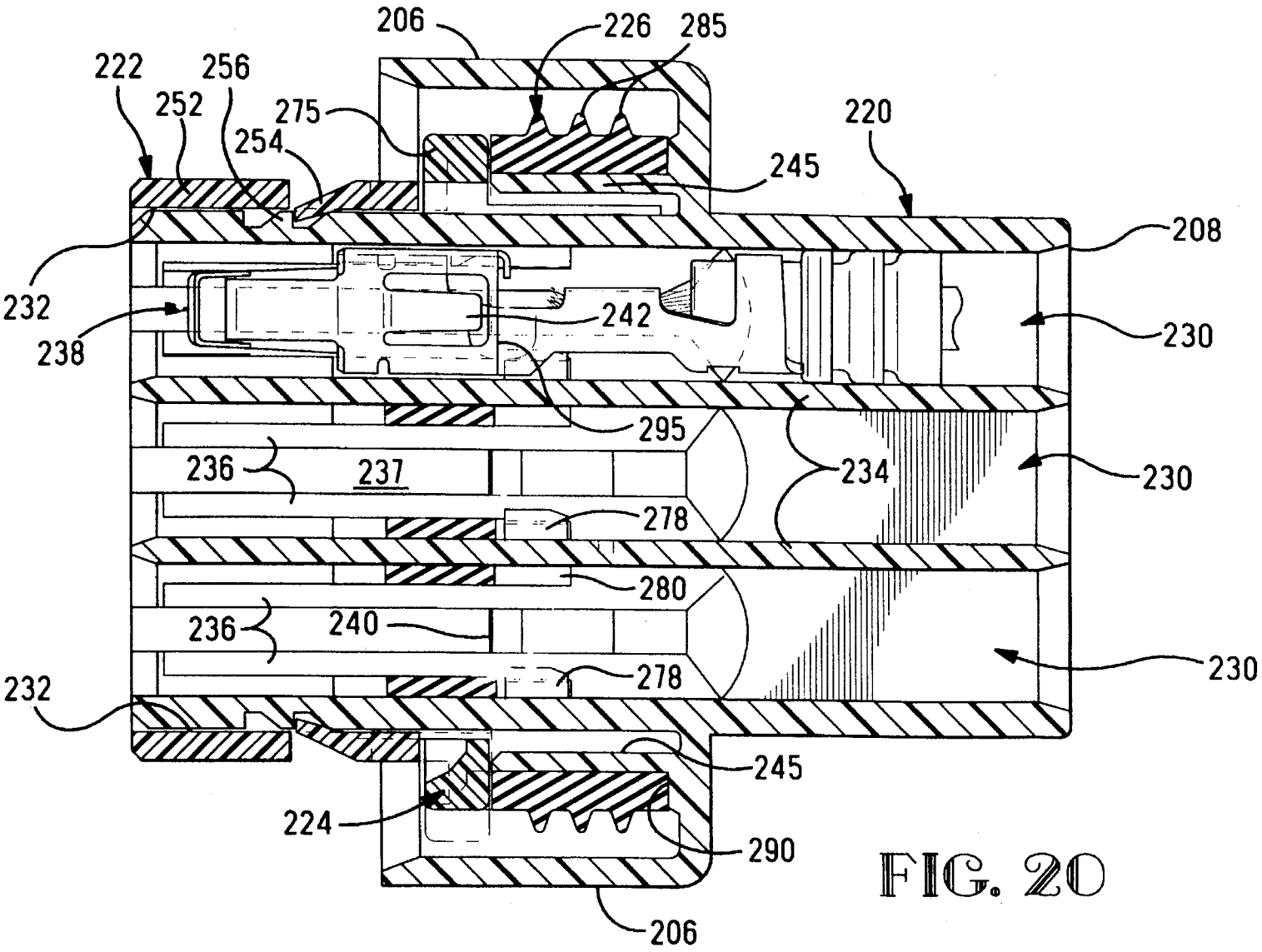
FIG. 20 is a cross sectional view through lines 20—20 of FIG. 16.
Figure 21:
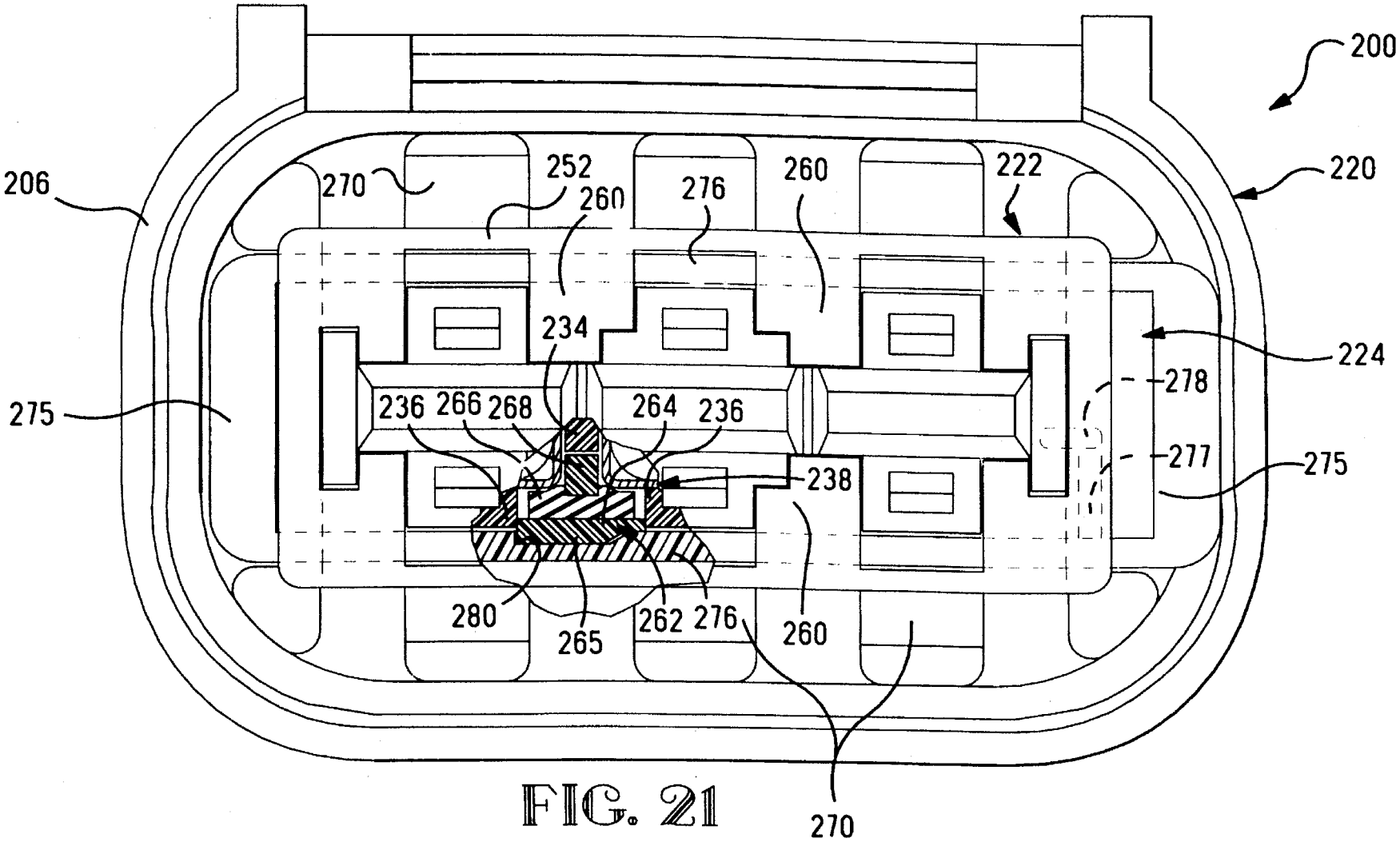
FIG. 21 is a view similar to that of FIG. 16 showing a portion of the electrical connector housing broken away to see the internal structure.
Figure 22:
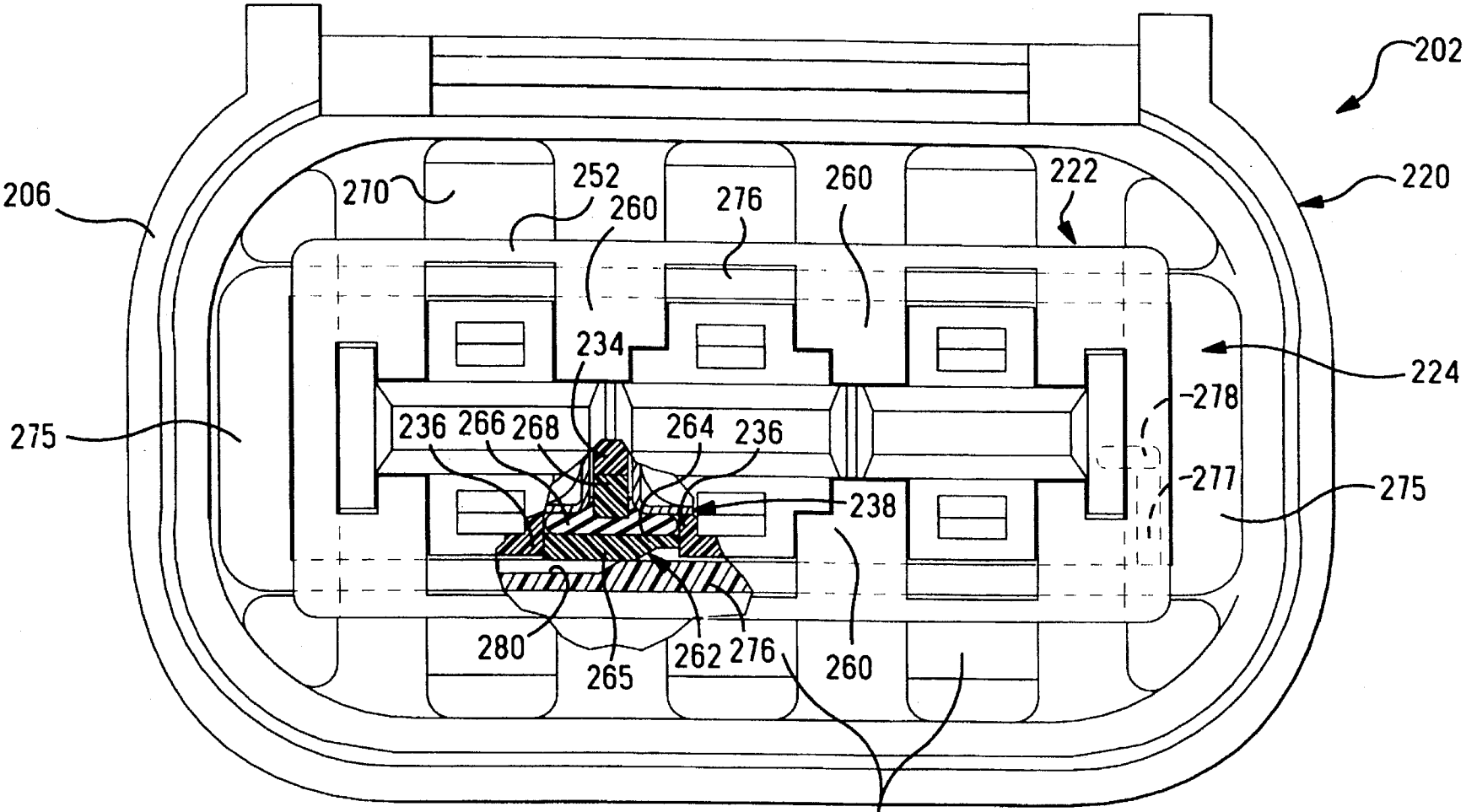
FIG. 22 is a view similar to that of FIG. 21 showing the connector in the fully assembled position.

With reference now to FIGS. 16–21, the rear housing portion 220 has, three terminal receiving passageways 230 extending through the rear surface 208. As shown best in FIG. 20, the main housing 220 has outside wall portions 232 which also can be seen from the front in FIG. 16. Separating each of the cavities are central wall portions 234 which do not extend the full height of the housing but are rather short ribs as shown in FIGS. 18 and 21. Also as shown in FIGS. 20 and 21, terminal platforms are formed at 236 which support the terminal 238, the supports 236 flanking a slot 237, also shown in FIGS. 20 and 21, which forms a shoulder at 240 to form a locking shoulder for the locking lance 242 of the terminal 238 as shown in either of FIGS. 19 or 20.

With reference again to FIGS. 16–21, the front housing portion 222 will be described in greater detail. With reference first to FIGS. 20 and 21, the front housing portion 222 is formed with a peripheral ring portion 252 having a locking lance at 254 which cooperates with a lug 256 on the wall portion 232. The housing portion 252 has a plurality of plate members such as 260 extending towards a centerline of the connector, as shown best in FIG. 21, behind which project extending wall portions 262. The wall portions 262 comprises an outer wide portion 264, an intermediate rubber portion 266 and a central rib portion 268, as will be described in greater detail. Also as shown in FIGS. 19 and 21, feet portion 270 extend from an end of the housing portion 252 of the front housing portion 222.

Figure 16:
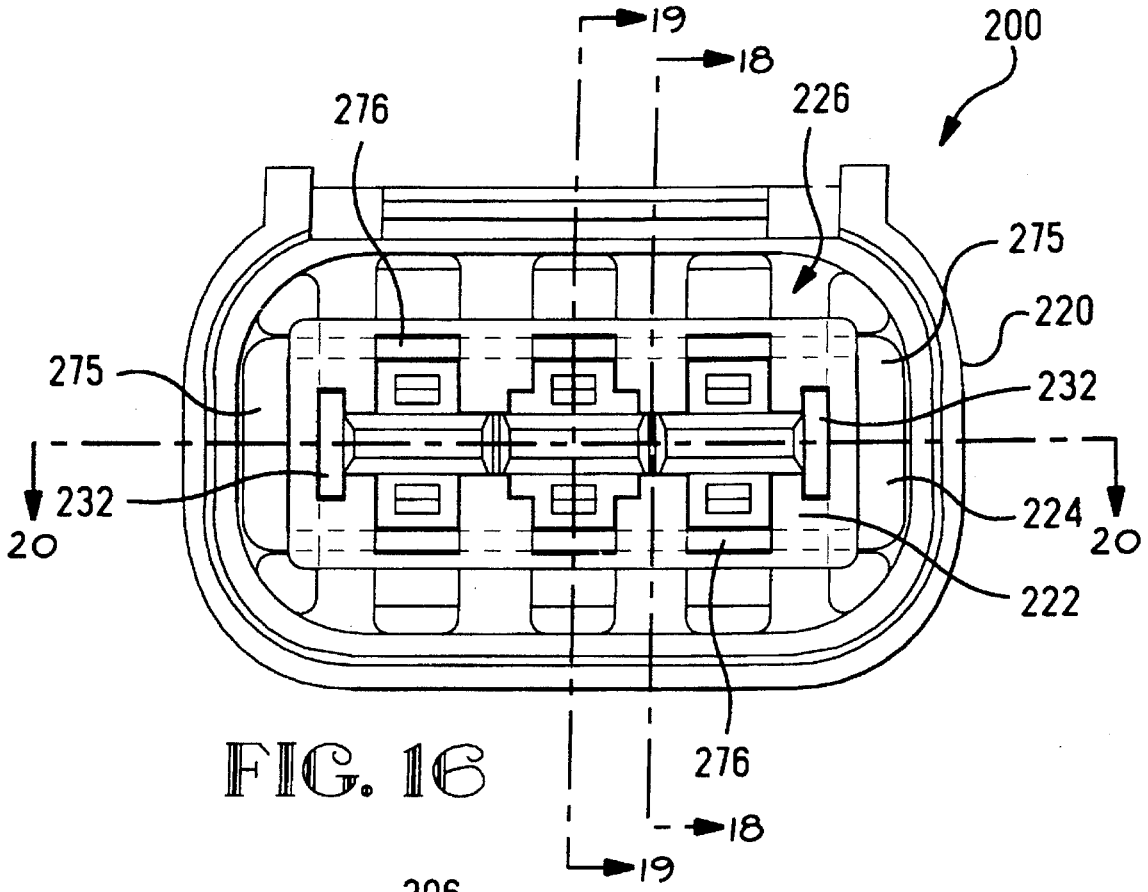
FIG. 16 is a front plan view of the electrical connector housing of the present invention.
Figure 17:
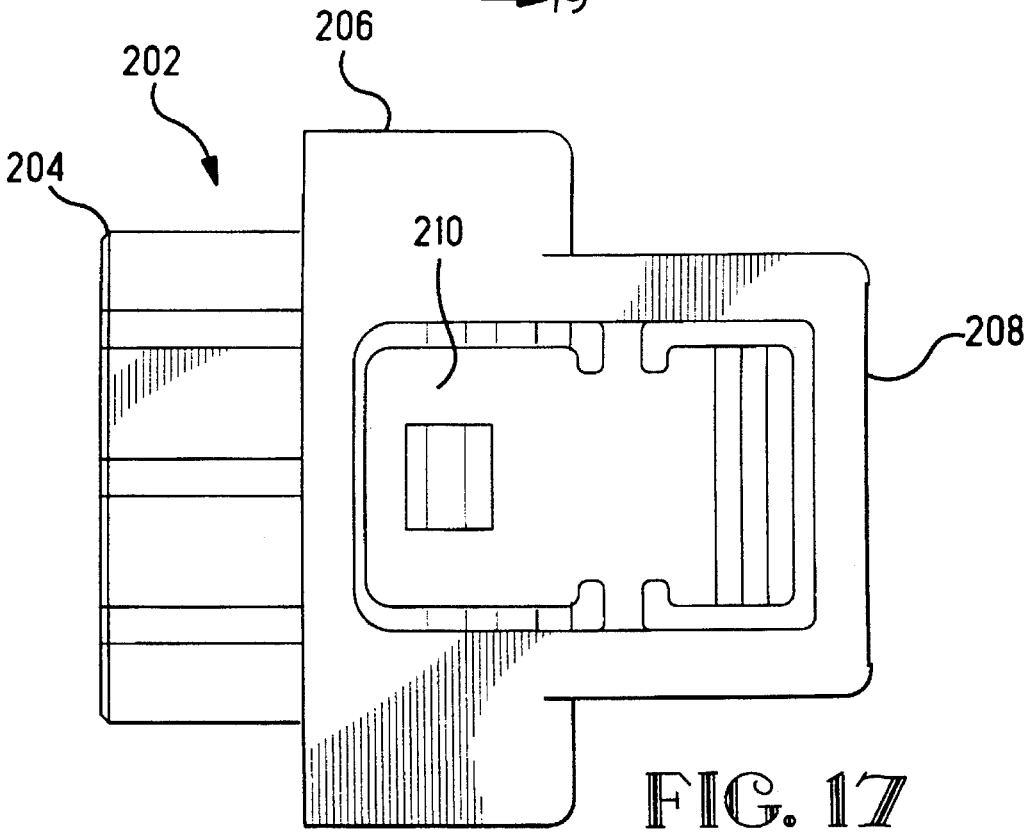
FIG. 17 is a top plan view of the housing shown in FIG. 16.
Figure 23:
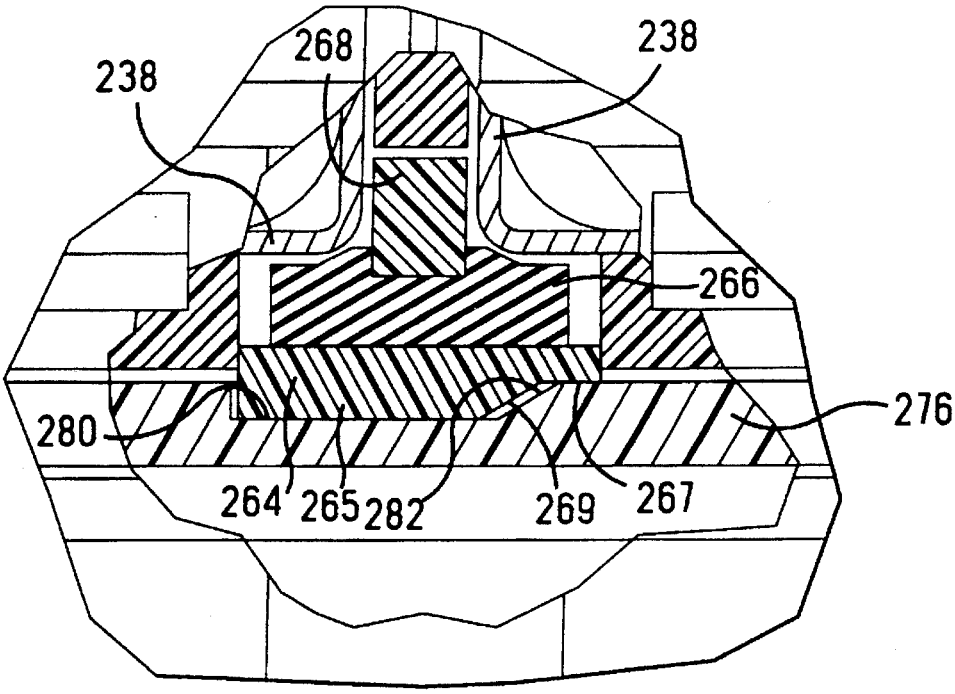
FIG. 23 is a view similar to that of FIG. 21 showing the cut-away section of FIG. 21 in greater detail.
Figure 24:
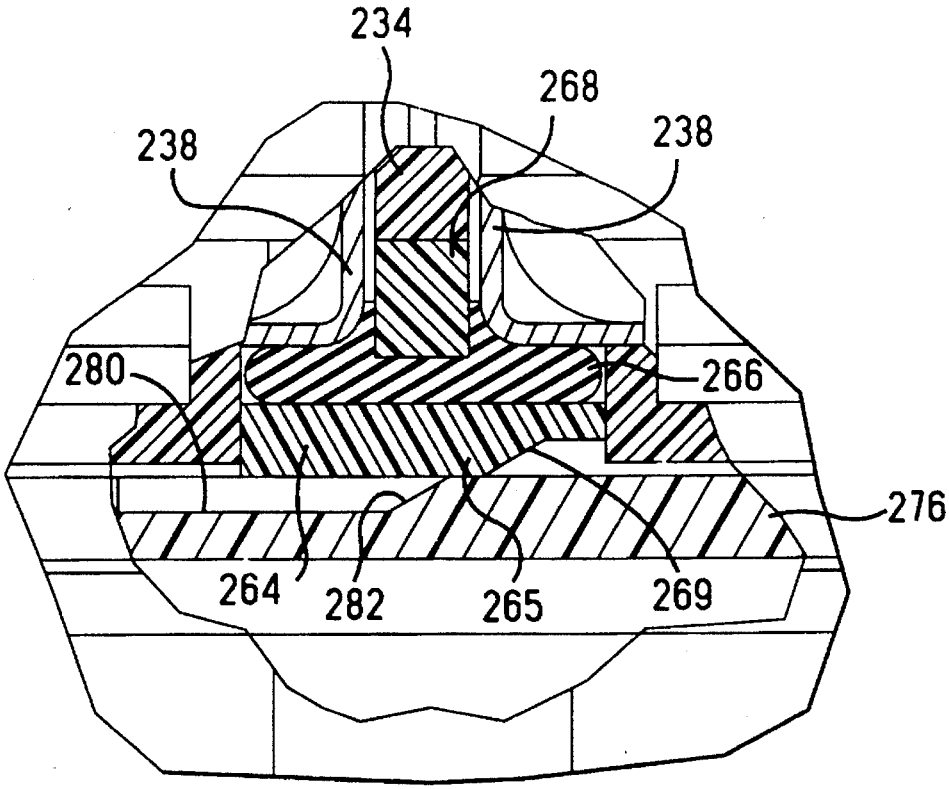
FIG. 24 is an enlarged view of the cut-away section of FIG. 22 in greater detail.

With respect now to FIG. 16, a locking slide 224 is shown including end plate portions 275 at either end thereof with intermediate rail portions 276 extending between the end portions 275. As best shown in FIG. 18, the rail portion 276 include a plate portion 277 extending downwardly towards the centerline of the cavity including a secondary locking plate member 278 attached thereto. It is worth noting at this point, and as shown in FIGS. 18 and 20, the moulding of the rear housing portion 220 forms a slot 280 between the platform portions 236, and above and below the central wall portion 234 as shown in FIG. 18. Finally, and as best shown in FIG. 23, the rail portions 276 include a cutout portion 280 to the central wall portions 234 of the rear housing portion 220.

With the connector components as described above, the electrical connector can be assembled as follows. The peripheral seal 226 is first slidably received, as shown in FIGS. 18 or 20, such that the rear edge of the seal contacts an inner wall portion 290 of the shroud member 206. The locking slide 224 can then be slidably received over the front of the housing member 220 such that the locking members 277 and 278 pass within the slots 280 to a position shown in FIG. 20, and when in this position, the end portions 275 come proximate to the wall portions 245 and prevent any further movement of the seal member 226. It should be noted that in FIG. 20, the locking slide 224 is shown in a fully locked position, however is movable to an unlocked position, shown in phantom, where the locking members 278 will pass within the slots 280 to a position above and below the central wall portion 234, as shown in FIG. 18.

For assembly of the front housing portion 222 to the housing portion 220, the locking slide 224 should be in the unlocked position. The front housing portion 222 can now be received onto the housing portion 220, whereby the plurality of wall portions 264 will be received intermediate the platform portions 236 to a position where the latches 254 snap into position against their corresponding locking lug, as shown in FIG. 20. In this position, the projection 265 on the plate portion 264 snaps into its corresponding recess 280 as shown in FIG. 23.

As assembled, a plurality of terminals 238 can now be received to a position where the locking lances 242 are snapped against their corresponding shoulders 240. The locking plate 224 can now be transversely slid between the position shown in FIG. 31 to its fully locked position Figure. In this position where each of the locking lugs 278 are moved transversely against a locking shoulder 295 of the terminal 238. The transverse movement of the locking member 224 causes the corresponding camming surfaces 269 and 282 (FIG. 23) to cooperate which moves the flexible wall portion 268 upwardly from a position shown in FIGS. 21 and 23 to a position shown in FIGS. 22 and 24 which causes a camming upward of the plate portion 264, and a concurrent movement of the rubber member 266 against an outer periphery of the terminals 238. This also causes the movement of the flexible portion 268 against the central rib portion 234. This causes each corner of the terminal to be held in a fixed position against the rubber member 266 thereby preventing any vibration of the terminal within the corresponding housing. It should be appreciated that an identical flexible wall portion 264 is positioned above the intermediate rib 234 as shown in FIG. 23, as best shown in FIG. 18.

Advantageously, an electrical connector according to the present invention includes a housing having a passage for receiving a terminal where wall sections of the passage are movable into an interfering relationship with the terminal, thereby preventing vibration or chatter of the terminal within the passage. This aids in the avoidance of frictional corrosion even in connector pairs where the two connectors move relative each other. A connector according to this invention is also sealable to protect the interconnection of the terminals from the environment. Additionally, latch arms that are joined together by a resilient strap connected to the housing may be provided that are in-line with the connector housing, thereby enabling improved mouldability of the housing and the latch arms are protected from tangling with the leads.

The above described invention may be incorporated into devices utilizing contacts different than those described herein. Furthermore, the invention is applicable to devices having one or more passages arranged in at least one row having at least one passage per row without departing from the intended scope of the invention.

We claim:

1. A one piece moulded electrical connector housing for mating with a mating electrical connector, the housing comprising a body having a forward mating face, a rear face, at least one terminal receiving passage opening said faces and a forwardly directed hood for receiving a mating portion of the mating connector, coplanar latch arms extending from the housing in the forward direction thereof each terminating in a latching head with a rearwardly facing latching shoulder for engaging a projection on a corresponding latching shoulder of the mating connector, the latch arms being resiliently deflectable between a normal position and a latching position; characterized in that the latch arms comprise at least one pair of latch arms joined together towards the rear face of the housing by a resilient strap connected to the housing body to provide a pivot point about which the latch arms are deflectable between said normal and latching positions, the latching heads projecting beneath a side wall of the hood and the remainder of the latch arms extending along said side wall, whereby the latch arms are in-line with the housing.

2. A housing as claimed in claim 1, characterized in that the resilient strap is substantially U-shaped comprising a pair of legs connected by a bight, each leg being connected at its end remote from the bight to the rear end portion of a respective latch arm and the centre of the bight being connected to the housing body to provide said pivot point.

3. A housing as claimed in claim 2, characterized in that each latch arm has an enlarged rear handle portion opposite to, and proximate to, the respective leg of the strap, a shank of reduced cross section extending forwardly from each handle portion and terminating in a respective latching head.

4. A housing as claimed in claim 3, characterized in that the strap is coplanar with the handle portions.

5. A housing as claimed in any one of claims 1–4, characterized in that the rear ends of the latch arms are covered by a frame connected to the housing body.

6. A housing as claimed in claim 5, characterized in that the frame is connected to the housing body by opposed, forwardly extending struts, each strut being connected to the strap of a respective pair of the latch arms at said pivot point.

7. A housing as claimed in claim 3, characterized in that in the normal position of the latch arms the latching heads thereof are proximate to each other, each latching head terminating in an inclined ramp surface, said ramp surfaces being oppositely inclined away from each other.

8. A housing as claimed in claim 1, characterized in that said side wall of the hood has a recess therein for receiving a core pin for forming the latching heads during moulding of the housing.

9. A housing as claimed in claim 8, characterized in that a forward part of the housing body, defining said passage projects into the hood, the hood and said forward part defining a forwardly open slot, a sealing grommet surrounding said forward part being retained thereon by a grommet retainer ring which is in turn retained on said forward part by a latching member engaged in a recess in said forward part, the recess in the hood side wall being aligned with the recess in said forward part, to allow that recess to be formed by said core pin.

10. An electrical connector housing comprising a main body having at least one terminal receiving passage extending therethrough, at least two latch arms having latching heads extending from said housing in a forward direction, said latch arms being joined to each other by a resilient strap, said resilient strap being connected to said main body at a pivot point located between a mating end and a rear end of said housing, whereby said latching heads can be rotated away from each other about said pivot point to an open position in order to receive a latching shoulder of a mating connector and then latch to the latching shoulder upon rotating back to a latching position by the action of said resilient strap.

11. An electrical connector housing as recited in claim 10 wherein said latch arms are each connected to a handle at a rear end so that when the handle is depressed inwardly, the latching heads rotate to the open position.

12. An electrical connector housing as recited in claim 11 wherein said resilient strap is generally U-shaped and defined by a pair of legs extending rewardly from a bight, said bight is connected to said pivot point and said legs are connected to said latching arms at rear ends thereof.

13. An electrical connector housing as recited in claim 12, wherein said latching arms are disposed inside a forwardly directed hood.

14. An electrical connector housing as recited in claim 11 wherein each latch arm has an enlarged rear portion opposite to, and proximate to, the respective leg of the strap, a shank of reduced cross section extending forwardly and terminating in its respective latching head.

15. An electrical connector housing as recited in claim 12 wherein said strap is connected to said main body by a strut at said pivot point.

16. An electrical connector housing as recited in claim 10 wherein said latching heads terminate in inclined ramp surfaces, said ramp surfaces being oppositely inclined away from each other.

* * * * *